United States Patent [19]

McCreadie

[11] Patent Number: 4,616,647

[45] Date of Patent: Oct. 14, 1986

[54] MOLDED FIBER DISPOSABLE FACE MASK HAVING ENHANCED NOSE AND CHIN FILTER-SEALS

[75] Inventor: John B. McCreadie, Shawnee, Kans.

[73] Assignee: Parmelee Industries, Inc., Kansas City, Mo.

[21] Appl. No.: 635,632

[22] Filed: Aug. 13, 1984

[51] Int. Cl.[4] ..... A62B 7/00

[52] U.S. Cl. ..... 128/206.19; 128/206.24

[58] Field of Search ..... 128/205.29, 206.12, 128/206.13, 206.14, 206.19, 206.28, 207.11, 206.24, 206.25

[56] References Cited

U.S. PATENT DOCUMENTS

| | | | |
|---|---|---|---|
| 2,939,458 | 6/1960 | Lundquist | 128/206.24 |
| 3,220,409 | 11/1965 | Liloia et al. | 128/206.19 |
| 3,861,381 | 1/1975 | Witman et al. | 128/206.12 |
| 4,319,567 | 3/1982 | Magidson | 128/206.19 |
| 4,384,577 | 5/1983 | Huber et al. | 128/206.19 |
| 4,454,881 | 6/1984 | Huber et al. | 128/206.19 |

*Primary Examiner*—Henry J. Recla

*Attorney, Agent, or Firm*—Schmidt, Johnson Hovey & Williams

[57] ABSTRACT

A disposable face mask is made up of molded fibrous sheet material which is formed to define a generally cup-shaped main body having two spaced, generally parallel, integral, interior nose portions filter-seals which are strategically located to engage opposed sides of the nose of the wearer. The mask body also desirably has an elongated, integral interior chin portion filter-seal which is positioned to engage the face underneath the wearer's chin. The nose and chin filter-seals cooperate to prevent passage of contaminated air beneath the peripheral edge of the mask and the user's face. The elongated nose filter-seals are especially effective in preventing passage of contaminated air along paths of travel which extend from the nose bridge encompassing part of the mask to the user's nostrils of mouth. The same is true of the chin filter-seal. The nose and chin portions preferably interconnect to form a continuous filter-seal around the periphery of the mask. In one embodiment, a groove comprised of crushed fibrous material delineates the elongated nose filter-seals from the remaining interior surface areas of the mask and assists in maintaining the generally cup shape of the mask.

2 Claims, 13 Drawing Figures

Fig. 1
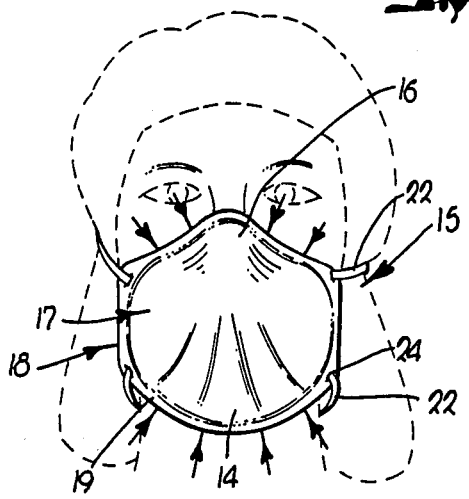
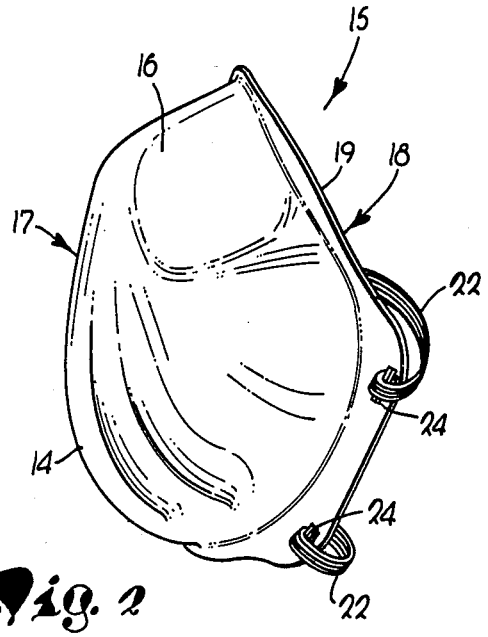
Fig. 2
Fig. 3
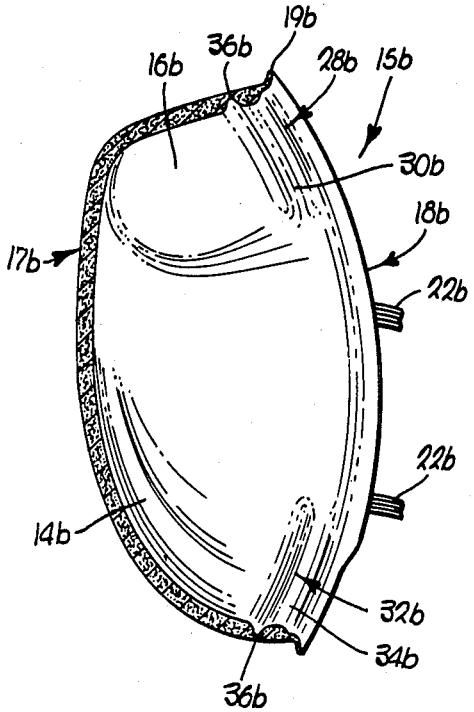

Fig. 6
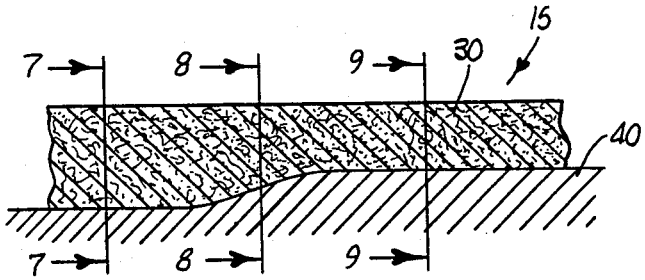
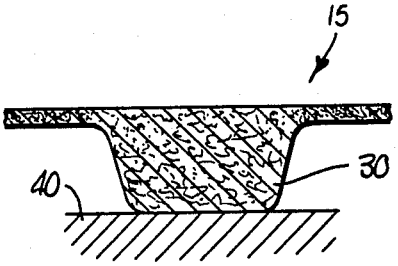
Fig. 7
Fig. 8
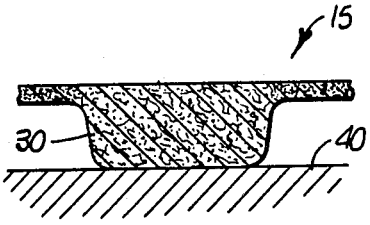
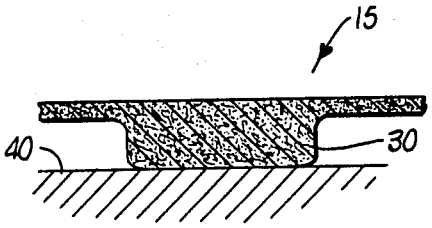
Fig. 9

MOLDED FIBER DISPOSABLE FACE MASK HAVING ENHANCED NOSE AND CHIN FILTER-SEALS

BACKGROUND OF THE INVENTION

1. Field of the Invention

My present invention relates to improvements in disposable face masks.

2. Description of the Prior Art

Face masks have widely been used to filter particulate matter from contaminated air. Otherwise such particulate matter, which may consist of either solid or liquid particles, may be inhaled and then transmitted to the upper respiratory tract or to a person's lungs, possibly triggering emphysema or a number of other respiratory conditions or diseases. Consequently, such masks fulfill a vital role in a wide variety of industrial and consumer applications.

Inexpensive face masks which are designed to be disposed of after a limited number of uses have enjoyed wide popularity. Such masks are commonly molded from a sheet of fibrous material into a configuration adapted to substantially seal against the face around the periphery of a mask. These masks must be constructed to accommodate a wide variety of facial sizes and configurations, and therefore the periphery does not always tightly engage and seal against the skin. Consequently, the wearer may be exposed to contaminated air leaking between the periphery of the mask and the face.

The problem of air leakage at the outer periphery is often aggravated after the mask is initially worn. When the fibers of the mask start to fill with particulate matter, the mask offers a greater resistance to air flow and subsequently a greater tendency for air leakage around the periphery is created. Unfortunately, the person using the mask is often unaware of this phenomena, because the overall resistance to air flow has remained substantially the same.

Attempts to eliminate air leakage in the nasal area have been generally unsuccessful. Occasionally, a small strip of U-shaped formable material such as metal has been secured to the mask over nose bridge area thereof and provided with leg portions which extend along both sides of the nose, with the intention that the strips will be conformably pressed against the nose by the wearer and thereafter cause the interior surface of the mask to provide a more effective seal between the interior of the mask and the ambient atmosphere. However, the use of such formable materials is subject to many disadvantages. The user may forget to press the strip against the side of his nose. Alternatively, the formable strip may become disfigured during use. Also, it may be impossible to reform material after several refittings of the respirator. Additionally, in order to allow ready manual forming of the strip as desired, such material must of necessity be relatively soft and have little memory. As a consequence, there was a tendency for such material to give and the U-shape to open, thus releasing the sealing pressure of the mask against the user's nose.

Similarly, previous face masks have not provided an adequate seal at the chin area of the face. Most respirators depend totally on the peripheral interior of the generally cup-shaped mask body of the respirator to prevent entrance of contaminated air around the chin. Again, because of the wide variety of facial sizes and structures, prior masks have often leaked in the chin area because the mask periphery did not properly match the general shape of the user's face.

Other respirators have used a complex shaped rounded seal, or a gas or liquid filled seal around the periphery of the mask. However, these seals are not suitable for disposable respirators which consist almost entirely of a molded sheet of fibrous material. As a result, disposable masks are often manufactured with no adequate peripheral chin seal, thereby exposing the user to possible inhalation of contaminated air.

SUMMARY OF THE INVENTION

According to the present invention, a nose filter-seal integral with a disposable face mask has been provided having substantial thickness to complementally engage both the sides and also the bridge of the nose of the wearer. The filter-seal serves the purpose of preventing unfiltered air from leaking between the mask and the face or of filtering air which passes through the seal.

Additionally, the invention provides an efficient chin filter-seal for the lower portion of the mask without significantly increasing the cost of the unit. The chin filter-seal functions either to preclude unfiltered air from leaking between the mask and the face or to filter air passing transversely through the filter-seal. The novel chin filter-seal effectively engages the face in the area underneath the chin and may also extend up and over the jaw bone. In a preferred embodiment, the chin filter-seal extends upwardly on both sides of the mask to meet the nose filter-seal.

Both the nose and chin filter-seals may be constructed the same material comprising the remainder of the mask, and be an integral part thereof molded as a one-piece unit. In such construction, the filter-seals will have an effective width such that air passing therethrough encounters a greater resistance than the air passing through the main body of the filter. The amount of air flowing through the filter-seal, as compared to the main body of the filter, is relatively small.

IN THE DRAWING

FIG. 1 is a front elevational view of the mask in use;

FIG. 2 is a perspective view of the mask;

FIG. 3 is a view of the mask showing one embodiment of my invention;

FIG. 6 is a longitudinal cross-sectional view of the filter-seal of the mask of FIG. 3 against the face of the wearer;

FIG. 7 is a view taken along the line 7—7 of FIG. 6;

FIG. 8 is a view taken along the line 8—8 of FIG. 6; and

FIG. 9 is a view taken along line 9—9 of FIG. 6.

DETAILED DESCRIPTION OF THE DRAWINGS

Figure 4:
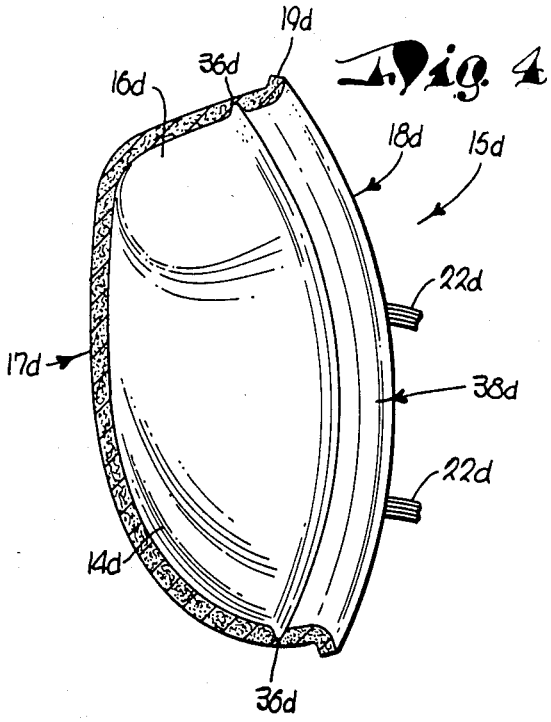
FIG. 4 is a view similar to FIG. 3 illustrating a different embodiment of my invention.
Figure 5:
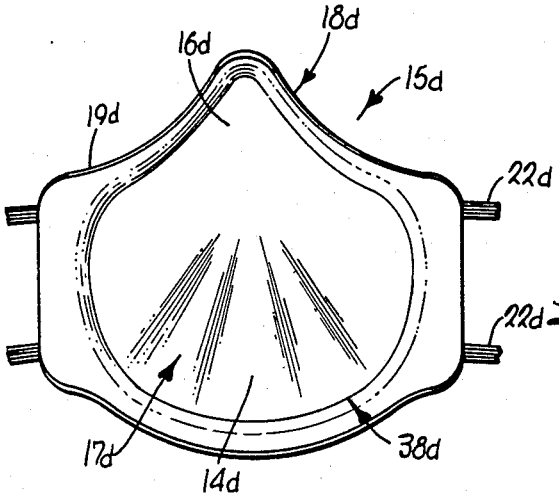
FIG. 5 is a rear elevational view of the embodiments shown in FIG. 4.

A disposable face mask 15 is fabricated of fibrous sheet material molded to fit against the face of a wearer. Broadly defined, the face mask 15 has a substantially cup-shaped member 17 with a bulged central section 14 and a medial, overlying, relatively narrow, channel-defining segment 16. The central section 14 fits over the mouth and a portion of the frontal chin area of the wearer, while the narrow channel-defining segment 16 overlies the nose and a portion of the cheek area of the wearer.

The elongated peripheral edge 18 surrounds the face mask 15 and has an outwardly extending border 19 which generally lies in a plane perpendicular to a plane tangential to an adjacent portion of cup-shaped member 17 at any given location. The peripheral edge 18 is of generally keyhole-shaped configuration defined by the generally semicircular shape of the lower bulged central section 14 and the upper narrow segment 16. Additionally, the upper portion of the peripheral edge 18 terminates in an inverted V-edge to fit over the bridge of the user's nose. Preferably, the V-edge communicates with the top of a narrow channel-defining segment 16.

The edge 18 provides a mounting area for a pair of elongated, elastic headstraps 22 which are attached to the edge 18 by means of wire staples 24. The upper headstrap 22 extends upwardly and loops around the back of the user's head while the lower headstrap 22 extends downwardly and loops around the back of the wearer's neck.

Viewing the embodiment shown in FIG. 3, a generally U-shaped region **28*b*, disposed on or adjacent the peripheral edge 18*b*, is integral with the interior of the channel-defining segment 16. A pair of nose filter-seals 30*b* of region 28*b* are disposed to engage the wearer's nose on opposite sides thereof. Similarly, a zone 32*b* integral with the interior of the bulged central section 14*b* has an elongated chin filter-seal 34*b* disposed to contact the wearer's face under his chin and extend upwardly to an area overlying the chin. The nose filter-seals 30*b* and the chin filter-seals 34*b*, as seen in FIG. 3, have substantially the same thickness as the cup-shaped member 17*b*, while a border 19*b* is substantially thinner. An elongated groove 36*b* separates the filter-seals 30*b* and 34*b* from the narrow channel-defining segment 16*b* and the bulged central section 14*b* respectively, such that the width of the nose filter-seal 30*b* and the chin filter-seal 34*b* is of dimension greater than the thickness of the face mask 15*b* excluding the border 19*b* and the groove 36*b*. The groove 36*b* may be constructed by removing a portion of the fibrous material, or alternatively may be comprised of material more tightly compacted than the remaining areas of the mask 15*b***.

In another embodiment, the face mask **15*d* as shown in FIG. 4 has a continuous peripheral rib filter-seal 38*d*. An elongated groove 36*d* delineates the rib filter-seal 38*d* from the remaining areas of the face mask 15*d*. As shown, the rib filter-seal 38*d* and the remaining areas of a face mask 15*d* are of substantially equal thickness. Again, the groove 36*d* may be constructed either by removing a portion of the fibrous material or by more tightly compacting the material in the vicinity of the groove 36*d***.

OPERATION

In use, the nose filter-seal **30*b* and the chin filter-seal 34*b* or, alternatively, the continuous peripheral rib filter-seal 38*d* are of substantial thickness to conform to the irregularities on the surface of the wearer's face, and also suitably engage the same even though facial dimensions and structure may vary widely between different individuals. Consequently, the filter-seals 30*b* and 34*b* or, alternatively, the continuous rib filter-seal 38*d* will compress and seal against the face and generally prevent the leakage of air between the peripheral edge 18 and the face of the wearer. The provision of two headstraps 22 insures that the face mask 15** is pulled in four different directions against the face to compress the filter-seals and generally provide an effective seal.

On those faces where the filter-seals **30*b* and 34*b*, or, alternatively, the peripheral rib filter-seal 38*b* are not compressed throughout its length sufficiently to prevent the passage of air, the filter-seal 30*b* and 34*b* or, alternatively, the peripheral rib filter-seal 38*d*, which are permeable to air, serve to filter particulate matter from any contaminated air that tends to flow transversely through the edge 18 adjacent the face of the wearer. The possible flow direction of air along these paths is illustrated in FIG. 1. Because the portions of the nose filter-seal 30*b*, the chin filter-seal 34*b* or the continuous rib filter-seal 38*d* through which air flows are partially compressed and are small and localized in area, they provide resistance to air-flow greater than similarly sized areas of the main body of the mask 15. Consequently, only a small part of the total airflow passes through these partially compressed portions, and does so at a relatively low velocity compared with the air flowing through the main body of the mask 15, making the air much easier to filter. It should also be noted when the face mask 15 is made from a plurality of fibrous sheets molded in overlying relationship, the air will not necessarily flow through all of the layers when passing through the filter-seal 30 and 34**; however, the air will be effectively filtered.

FIGS. 6–9 illustrate the compressibility of the nose filter-seal **30*b* against the normal irregularities normally present on a portion of skin 40 of the face. In FIG. 7, the filter-seal 30*b* is uncompressed and capable of filtering particulate matter. In FIG. 9, the filter-seal 30*b* is fully compressed and consequently offers a high resistance to air flow within. FIG. 8 illustrates a filter-seal 30*b* that is partially compressed and offers a resistance to air passage intermediate the resistance of a fully compressed and an uncompressed filter-seal. However, in all three cases, the filter-seal 30*b* tightly engages the skin 40 to prevent passage of unfiltered air therepast. Moreover, the chin filter-seal 34*b* or, alternatively, the continuous rib filter-seal 38*d* would similarly compress, filter and seal against the skin 40** of the wearer.

Furthermore, the groove **36*d* as illustrated in the embodiments of FIG. 4 may be provided by suitable crushing of the fibrous sheet material during manufacture of the mask. These crushed areas, in addition to delineating the filter-seal region 28 and the filter-seal zone 32, also serve the purpose of maintaining the desired shape of the mask. As a result, the filtering and sealing effectiveness of the peripheral edge 18** is not diminished over a period of extended or to a certain extent repeated use.

I claim:

1. In a disposable face mask adapted to filter air breathed by a user through either his nostrils or mouth, said mask being fabricated of integral porous sheet material molded to a configuration adapted to fit over the wearer's mouth and under his chin with an upper narrowed, channel-defining segment configured to accommodate the wearer's nose, the peripheral edge of the mask being of generally keyhole shaped configuration with the narrow channel segment terminating in an inverted V-edge which is adapted to fit over the bridge of the user's nose and complementally engage the wearer's cheeks on each side of his nose, the remaining peripheral edge of the mask being of generally semicircular shape and adapted to complementally fit against the wearer's face along the sides of his cheeks and beneath his chin, the improvement of which comprises:

a generally U-shaped region integral with the interior of the channel-defining segment of the mask adjacent the periphery of said V-edge and having opposed, elongated, outwardly diverging legs presenting permeable nose filter-seals adapted to contact the wearer's nose on opposite sides thereof and provide a seal against leakage of air between the nose filter-seal and the face of the wearer, said nose filter seals being of substantially the same thickness as the remaining inward areas of the mask and presenting generally planar elongated surface portions configured to lie in flat engagement with the wearer's face across the transverse width of each of the nose filter-seals when the latter are in normal compression against the wearer's face; and a U-shaped area of the channel-defining segment inboard of the U-shaped region thereof being compressed to a degree greater than the compression of said nose filter-seals when the latter are in normal compression against the wearer's face to define a U-shaped groove complemental with said U-shaped region and having leg portions and separating said nose filter seal portions from the remaining inwardly lying areas of the mask, each of said nose filter-seals having an inboard edge defining an outboard side of the respective leg section of said groove, said leg sections of the groove terminating in proximal relationship to the outer terminal ends of the nose filter-seal leg portions and defining opposed, diverging passageways open to the interior of the mask when the latter is fitted in place over the wearer's face for the discharge of air flowing through said nose filter-seal portions toward the wearer's nose and mouth, the remaining portions of said channel-defining segment inboard of said U-shaped region spaced from the wearer's face a distance such that when said mask is fitted to the wearer air may flow freely through said nose filter seals at any path transverse to the entire length thereof and travel along an unobstructed path transverse to respective longitudinal axes of said nose filter-seals and directly to the wearer's nose, said groove-defining U-shaped area of the channel-defining segment being cooperable with said nose filter-seal leg portions to maintain the normal shape of the mask.

2. The invention of claim 1; and a permeable, generally C-shaped chin filter-seal region integral with the interior of the mask adapted to contact the wearer's face under his chin and having end sections terminating above the chin to an area adjacent the mouth and provide a seal against leakage of air between the chin filter-seal and the face of the wearer, said chin filter-seal region being of substantially the same thickness as the remaining inward areas of the mask and presenting an elongated portion adapted for flat engagement with the wearer's face when in normal compression against the latter; and the sheet material making up the mask being provided with a substantially C-shaped groove complemental with and disposed inwardly of said chin filter-seal and separating said chin filter-seal region from the remaining inward areas of the mask, said groove having leg sections terminating in proximal relationship to the outer terminal ends of said chin filter-seal region thereby defining a passageway for the discharge of air flowing through said chin filter-seal toward the wearer's nose and mouth.

* * * * *